United States Patent [19]

MacIntyre et al.

[11] Patent Number: 5,013,187

[45] Date of Patent: May 7, 1991

[54] POSITIONING COMPONENTS AND ENERGIZING SEALING ASSEMBLIES THEREFOR

[75] Inventors: Brian MacIntyre, Milngavie; Frank Close, Airdrie; Sean McAvoy, Coatbridge, all of Scotland

[73] Assignee: Cooper Industries, Inc., Houston, Tex.

[21] Appl. No.: 383,117

[22] Filed: Jul. 20, 1989

[30] Foreign Application Priority Data

Jul. 22, 1988 [GB] United Kingdom ..... 8817554

[51] Int. Cl.[5] ..... F16L 1/12

[52] U.S. Cl. ..... 405/169; 285/104; 285/109; 285/140; 285/343; 166/348

[58] Field of Search ..... 285/3, 24, 27, 32, 105, 285/104, 108, 109, 113, 133.2, 139, 140, 141, 147, 339, 340, 341, 342, 343, 346, 348, 352; 166/342, 344, 348, 360, 119, 139, 182, 216; 405/169, 170

[56] References Cited

U.S. PATENT DOCUMENTS

| | | | |
|---|---|---|---|
| 3,105,552 | 10/1963 | Haeber et al. | 285/140 X |
| 3,353,596 | 11/1967 | Brown | 285/140 X |
| 4,010,804 | 3/1977 | Garcia | 166/216 X |
| 4,018,272 | 4/1977 | Brown et al. | 166/119 |
| 4,416,472 | 11/1983 | Fowler et al. | 285/3 |
| 4,519,633 | 5/1985 | Nichols | 285/3 |
| 4,691,780 | 9/1987 | Galle, Jr. et al. | 166/348 |
| 4,771,828 | 9/1988 | Cassity | 285/139 X |
| 4,778,008 | 10/1988 | Gonzalez et al. | 285/3 X |
| 4,836,288 | 6/1989 | Wester | 285/140 X |
| 4,836,579 | 6/1989 | Wester et al. | 285/3 |
| 4,886,113 | 12/1989 | Ross et al. | 285/3 X |

*Primary Examiner*—Dennis L. Taylor
*Assistant Examiner*—J. Russell McBee
*Attorney, Agent, or Firm*—David A. Rose; Ned L. Conley

[57] ABSTRACT

The invention relates to a method and apparatus suitable for example in enabling the installation of a casing hanger within a bore in an oil-drilling wellhead in a manner so that the installation and the sealing-in of the casing hanger is accomplished in a single operation. The invention thus comprises installing a component (2) within a bore (4) so as to be received therewithin in a fluid-type manner utilizing expandible seals (8) and a shoulder (36) within the bore (4) adapted to be contacted by a leading edge (32) of one of two concentrically arranged sleeve members (12, 14) which are driven downwardly within the bore towards the shoulder, the two sleeve members which encircle the component (2) being secured together by shearable links (25). The movement of one (12) of the sleeve members towards the shoulder (36) is arrested by its abutment against the shoulder, but the driving force continues to be applied to the second sleeve member (14) so as to shear the shearable link (25) and permit further movement of second member (14), so as to vertically compress and thus expand the seals (8) radially and ensure a fluid-tight seal between the component (2) and the inner surface of the bore (4).

11 Claims, 1 Drawing Sheet

POSITIONING COMPONENTS AND ENERGIZING SEALING ASSEMBLIES THEREFOR

Figure 1:
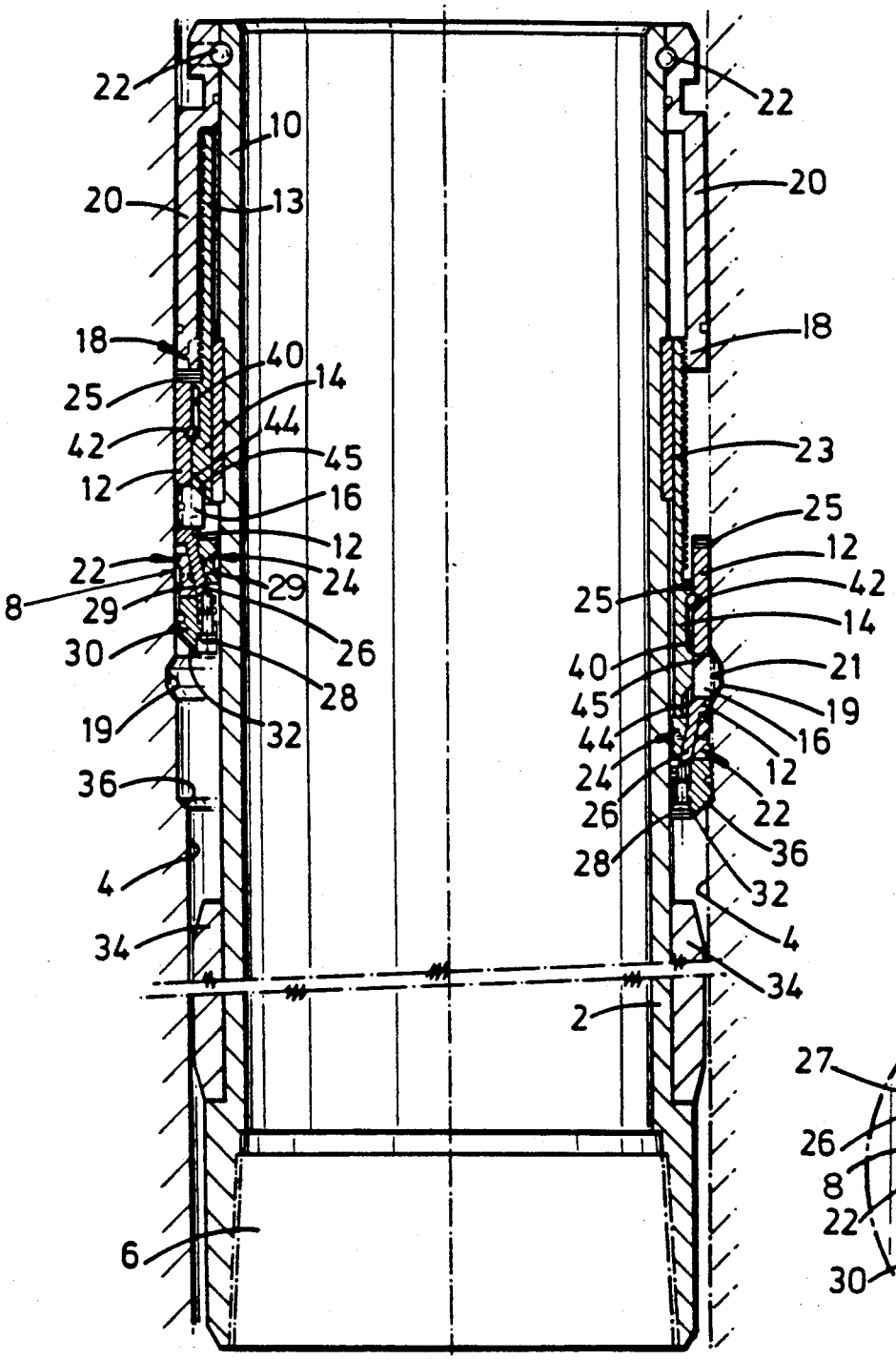
Figure 1A:
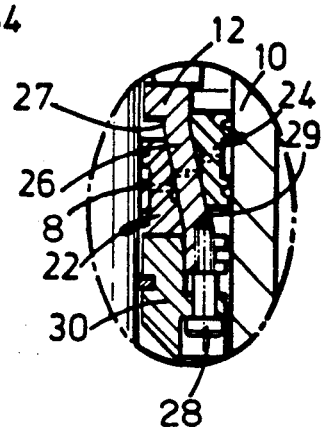

The invention relates to the positioning of connectible components and the energization of sealing assemblies therefor, for example, metal-to-metal seals.

Metal-to-metal seals are preferable to other types in many situations, for example, in the oil drilling industry where wellhead seals must withstand high temperatures and pressures, thermal cycling and chemical attack.

A metal-to-metal seal of the wedge type may successfully be used in connection with the packoff element of the wellhead drill assembly. This type of wedge seal, known as a Canh seal, comprises two metal seal rings each have complementary frusto-conical confronting surfaces and are received one within the other. The outer ring may for example seal the inner surface of the wellhead wall and the inner ring seals against the outer peripheral surface of the casing or mandrel hanger.

Axial compressive force applied to the rings produces controlled radial expansion so that contact is made between convex annular ribs on the seal rings and the wall surfaces to the sealed. These ribs comprise two pairs of ribs on each surface adapted to contact a wall surface.

However, before the seals are required to be energized it is necessary to install the casing hanger to which is secured the final length of casing in the series of casing portions, referred to as the casing string. This involves positioning the casing hanger correctly with respect to the wellhead body and the final one of the casing string. Once this is achieved, the operator is then able to initiate the energization of the seals.

It is an object of the invention to permit the accurate installation of the components to be sealed and the energization of the sealing assembly in a single operation.

The invention therefore provides a method of installing a component within a bore so as to be received therewithin in a fluid-tight manner by means of expandable sealing means, comprising providing a shoulder within the bore adapted to be contacted by a leading edge of an annular installation means, means to drive two concentrically arranged sleeve members of said installation means within the bore towards the shoulder, said two sleeve members encircling said component and being secured together by shearable link means, causing the movement of one of said members towards the shoulder to be arrested by abutment of said installation means against said shoulder, continuing to apply driving force to the second sleeve member so as to shear said link means and permit further movement of said second member, said further movement operating energization means adapted to expand the sealing means and ensure a fluid-tight seal between the component and the inner surface of the bore.

Advantageously, the movement of the second sleeve member within the bore is adapted to force keying members into recesses provided in the bore surface.

The invention further provides apparatus for the installation of a component within a bore, said apparatus having installation means comprising a plurality of annular members including two concentrically arranged sleeve members adapted to encircle the component and to be received in an at least partially over-lapping relationship, shearable link means linking said members together in said over-lapping relationship, driving means adapted to drive said annular members into said bore, an annular member of said installation means having a leading edge adapted to abut a reference shoulder within the bore and thereby to prevent further movement of one of said sleeve members while permitting further movement of the other, expandable sealing means adapted when energized to engage the component and the bore wall in a fluid-tight seal, the construction and arrangement being such that during said further movement permitted of the second mentioned sleeve, said shearable links are broken and the expandable sealing means are energized.

There will now be described an example of apparatus and of a method both according to the invention. It will be understood that the description, which is to be read with reference to the drawing, is given by way of example only and not by way of limitation.

The drawing is a composite sectional view taken on a longitudinal plane through apparatus according to the invention. The left hand side of the drawing illustrates the device at an intermediate step in the installation method and the right hand side shows the device in a fully installed and energized condition. The drawing also includes an enlarged-scale fragmentary portion corresponding to a detail of the left hand side of the drawing.

The drawing illustrates the installation of a casing hanger 2 in a bore 4 of a wellhead body. The casing hanger 2 is provided at a lower end portion thereof with an internal thread 6, to which the final one of a series of casings is to be connected.

A radially expandable sealing means in the form of a wedge or Canh seal 8 is provided to ensure a fluid-tight seal between the casing hanger and the wall of the wellhead bore 4.

Surrounding an upper portion 10 of the casing hanger 6 are two sleeve members 12, 14 of installation means according to the invention.

An upper portion 13 of the member 14 is provided with an external thread engageable with an internal thread 18 of a running ring 20. The running ring, which provides the driving means, is mounted for rotation about the upper portion 10 of the casing hanger 2 on spherical bearings 22. A T-slot formed in the ring 20 serves for suspending the assembly during installation and for connection to a conventional running tool (not shown). When the running tool is operated the ring 20 rotates causing the sleeve member 14 to move axially downwards as viewed in the drawing due to the provision of keying members 23 preventing rotation of the sleeve 14 relative to the casing hanger 2.

Because of the provision of shearable links in the form of pins 25 between the sleeve member 14 and the sleeve member 12, both members 12 and 14 initially move together. Arranged within recesses in the sleeve member 12 is a series of radially movable segments 16 adapted when fully installed to be received in a groove 19 formed in the wellhead bore 4. The segments are retained by a retainer ring 21.

The sealing means 8 comprise an outer and an inner annular metal member 22 and 24 respectively, each having sealing ribs adapted to engage the bore 4 and casing 2 respectively. Confronting surfaces of each member 22 and 24 are frusto-conical, tapering at the same angle, and are separated by a lower annular extension of the sleeve 12 which forms an intermediate ring member 26 having frusto-conical inner and outer surfaces 29, 27 complementary to the confronting surfaces of the rings 22 and 24. The three rings 22, 24, 26, form a known type of wedge or Canh seal.

A lower rim of the ring 26 is provided with headed pins 28 on which is supported for limited axial sliding movement, a ring member 30 having a leading edge 32.

The installation procedure is as follows:

The end casing portion to be secured to the series of casings is attached to the casing hanger 2 by means of the internal thread 6.

The assembly comprising the above described parts in the relative positions shown on the left-hand side of the drawing is then lowered into the bore 4 with the help of guide ribs 34 until a predetermined reference level is reached, a so-called mudline. Connection is made to the series of casing parts and a lifting force substantially equal to the weight of the casing series and the assembly is applied to the T-slot in the ring 20 to avoid damage to the casing series.

The running ring 20 is then rotated so that the member 14 commences to move axially downwards together with the sleeve member 12 and the Canh seal 8, until the leading edge 32 of the ring member 30 contacts a shoulder 36 formed in the bore 4.

Continued rotation of the ring 20 however maintains the axial force on the sleeve 14 and its downward progress. The sleeve 12 on the other hand is prevented from further downward movement since the ring member 30 can move no further.

The pins 25 thus shear and the sleeve 14 continues to descend. Linear movement in an axial direction is maintained by the provision of vertical slots 40 in the sleeve 14 in which run spherical bearings 42 received in an annular groove formed on the inner surface of the sleeve 12.

As the sleeve 14 descends a cam surface 44 formed thereon commences to act on a complementary surface 45 of the blocks 16 and to force them (only one shown) to move radially outwards to engage with the groove 19 in the bore 4.

At the same time a leading edge of the sleeve 14 bears down against the upper surface of the sealing ring member 24 forcing it to slide downwardly and inwardly with respect to the inside frusto-conical surface 29 of intermediate member 26, which member 26 is moving downwardly relative to the sealing ring member 22, so forcing the latter outwardly with respect to the outside frusto-conical surface 27 of the member 26, thus bringing about the energization of the Canh seal as illustrated in the right hand side of the drawing.

It will be observed that the sealing ring member 22 is forced outwards against the bore 4 not only by the pressure exerted thereupon by the movement of the rings 24 and 26, but also by the movement of the ring member 30 on the pins 28 which member 30 presses upwardly on the member 22 adding to the upward and outward movement of the intermediate ring member 26 to achieve the required increase in radial dimension.

According to the above procedure therefore, it is possible to install and energize the assembly of components in a single trip operation.

The sealing positions of the parts shown above may be released by rotation of the running ring 20 in the reverse direction to allow the sleeve 14 to climb back up the threaded portion 18. It will be understood that the sheared pins 25 will be replaced if it is required to re-set the seal.

Various modifications may be made within the scope of the invention as defined by the following claims.

What is claimed is:

1. Apparatus for sealing the annulus formed by the installation of an inner annular member within the bore of an outer annular member having a reference shoulder, comprising:

first and second concentrically arranged sleeve members at least partially over-lapping relationship and disposed around the inner annular member for reciprocable movement with respect thereto, shearable link members linking said sleeve members together in said over-lapping relationship, a driving member for driving said sleeve members into said annulus, said first sleeve member having a leading edge for abutting the reference shoulder within the annulus to prevent further movement of said first sleeve member while permitting further movement of said second sleeve member, an expandable sealing member adapted when energized to engage the walls of the annular members in a fluid-tight seal, the construction and arrangement being such that during said further movement permitted of said second sleeve member, said shearable link members are broken and the expandable sealing member is energized.

2. Apparatus as claimed in claim 1, wherein the expandable sealing member is a metal-to-metal wedge seal comprising at least two concentric ring members capable of relative movement therebetween, each ring member having a frusto-conical surface facing a complementary frusto-conical surface on the adjacent ring member.

3. Apparatus as claimed in claim 1, wherein the expandable sealing member is a metal-to-metal wedge seal comprising:

inner, intermediate and outer concentric ring members capable of relative movement therebetween, the inner and outer ring members having a frusto-conical surfaces and the intermediate ring member having two opposed frusto-conical surfaces each adapted to complement a confronting one of the inner and outer ring member surfaces, said intermediate ring member being formed integrally with said first sleeve member.

4. Apparatus as claimed in claim 1, wherein said driving member comprises:

a rotatable running ring having a screw-threaded engagement portion, a second screw-threaded portion being provided on said second sleeve member, said second sleeve member being provided with keying members to prevent relative rotational movement between said first and second sleeve members and between said sleeve members and the annular members.

5. Apparatus as claimed in claim 1, wherein said first sleeve member is the outer sleeve member and is carried on said second sleeve member to move therewith while said shearable link members remain unsheared.

6. Apparatus as claimed in claim 1, wherein said second sleeve member is provided with a beveled surface at its leading edge portion and said first sleeve member is provided with axially captive but radially moveable segment members each having a cammed surface contractible by the beveled surface of said leading edge portion so as to cause outward radial movement of said segment members to engage the outer annular member.

7. A method of installing an inner annular member within a bore of an outer annular member so as to be received therewithin in a fluid-tight manner by means of expandable sealing means, comprising:

providing a shoulder within the bore of the outer annular member adapted to be contacted by a leading edge of an annular installation member, driving two concentrically arranged sleeve members within the bore towards the shoulder, encircling said inner annular member by the sleeve members and securing the sleeve members together by shearable links, moving one of the sleeve members towards the shoulder to be arrested by abutment of the sleeve member against the shoulder, continuing to apply a driving force to the other sleeve member so as to shear the shearable links and permit further movement of the other sleeve member, said further movement operating energization means on the sleeve members to expand the sealing means and ensure a fluid-tight seal between the inner annular member and the inner surface of the bore of the outer annular member.

8. A method as claimed in claim 7, wherein the movement of the other sleeve member within the bore forces keying members provided on one of the sleeve members into recesses provided in the surface of the outer annular member.

9. A method as claimed in claim 7 further including the steps of:

mounting a running ring around the inner annular member;

screw-threadingly engaging the running ring to the other sleeve member;

keying the other sleeve member to the inner annular member; and rotating the running ring to screw-threadingly engage the other sleeve member while the other sleeve member is prevented from rotating by the keying.

10. A method as claimed in claim 7 further including the step of preventing relative rotational movement between the two sleeves.

11. An apparatus for sealing a wellbore annulus, comprising:

an outer annular member having an upwardly facing support shoulder and an annular groove disposed above said support shoulder;

an inner annular member adapted to be received within said outer annular member for suspending a string of casing, said inner and outer annular members forming the wellbore annulus;

a rotatable member rotatably disposed around said inner annular member;

an actuator sleeve reciprocally mounted on said rotatable member upon the rotation of said rotatable member;

means for preventing the rotation of said actuator sleeve upon the rotation of said rotatable member;

a support sleeve releasably disposed on said actuator sleeve by a shearable member;

a plurality of expandable segments housed in apertures on said support sleeve;

said actuator member having a cam surface for engaging and camming said segments into said annular groove;

said support sleeve having a downwardly facing annular shoulder and an upwardly facing annular shoulder;

a first sealing member supported on said support sleeve adjacent said downwardly facing annular shoulder and a second sealing member supported on said support sleeve adjacent said upwardly facing annular shoulder;

a stop ring reciprocally mounted on one end of said support sleeve and adapted for engagement with said upwardly facing support shoulder whereby;

upon the rotation of said rotatable member, said actuator sleeve moves downwardly such that said stop ring engages said upwardly facing support shoulder;

upon arresting the downward movement of said stop ring, the further downward movement of said actuator member shears said shearable member allowing said actuator member to continue downward movement and cam said segments into said annular groove, simultaneously compressing said first sealing member between said stop ring and said downwardly facing annular shoulder, the further downward movement of said actuator member compressing said second sealing member against said upwardly facing annular shoulder.

* * * * *